United States Patent [19]

Kawamura et al.

[11] 4,200,795

[45] Apr. 29, 1980

[54] PULSATE X-RAY GENERATING APPARATUS

[75] Inventors: Kazumitu Kawamura, Yokohama; Mitsuru Yahata, Tokyo, both of Japan

[73] Assignee: Tokyo Shibaura Electric Co., Ltd., Kawasaki, Japan

[21] Appl. No.: 906,683

[22] Filed: May 16, 1978

[30] Foreign Application Priority Data

May 18, 1977 [JP] Japan ..... 52-62645[U]

[51] Int. Cl.[2] ..... H05G 1/30

[52] U.S. Cl. ..... 250/402; 250/409; 250/413; 250/418

[58] Field of Search ..... 250/401, 402, 417, 418, 250/421, 408, 409, 413

[56] References Cited

U.S. PATENT DOCUMENTS 3,828,194 8/1974 Grasser ..... 250/408

*Primary Examiner*—Craig E. Church

*Attorney, Agent, or Firm*—Cushman, Darby & Cushman

[57] ABSTRACT

A capacitor connected between the anode and cathode of an X-ray tube through an X-ray switch is charged by a DC output voltage including ripple component from a rectifier connected to the secondary of a high-tension transformer. The primary of the high-tension transformer is connected to a switching circuit. A switching control circuit produces a turn-on signal for the switching circuit when a pulse signal derived from a phase detector in synchronism with a given phase of the ripple component, an X-ray exposure instruction signal and a charge instruction signal formed in a comparator are logically processed, and a turn-off signal when the charge voltage of the capacitor reaches a given value. The switching circuit is ON-OFF controlled by the switching control circuit.

6 Claims, 7 Drawing Figures

PULSATE X-RAY GENERATING APPARATUS

The present invention relates to an X-ray generating apparatus for producing pulsate X-rays primarily used in a computed tomography apparatus.

There has recently been put into practice a diagnostic X-ray apparatus, called computed tomography apparatus, in which data concerning the X-rays after passing through an object to be diagnosed is analized by a computer and a tomograph of the object is displayed by a television monitor.

In the computed tomography, the X-ray tube and an X-ray detector, which are oppositely positioned, rotate around the object such as a patient. The absorption data of the X-rays after passing through the patient, which is obtained for a given angle of rotation, is analyzed by a computer and the tomograph of the patient is visualized on a television monitor.

The computed tomography needs the X-ray absorption data discontinuously collected, i.e. for a given rotational angle, but does not need a continuous radiation on the patient. Such discontinuous radiation of X-rays is preferable because of the necessity of the minimum possible dosage of X-ray radiation onto the patient. Therefore, pulsate X-ray generating apparatus is desirable, which radiates no X-rays when no data is collected.

In this type X-ray generating apparatus, shown in FIG. 1 is a known power source circuit constructed by taking such necessity into account. In this circuit shown in FIG. 1, a switching circuit 42 connected to a neutral point of the star-connected primary winding of a high tension transformer 4 connected to a three-phase AC power source is closed by a control signal generated from a switching control circuit 43. A high voltage appears at the output terminals of the secondary windings of the star-connection and delta connection in the high-tension transformer 4. The high voltages thus obtained are then applied to rectifiers 12 and 14 and the rectified ones are applied to charge a couple of high tension capacitors 16 and 18, respectively. The charge voltages of the capacitors 16, 18 are applied through resistor circuits including resistors 34, 36, 38 and 40 to a comparator 100 where these voltages are compared with a reference voltage (not shown). When the charge voltages reach a predetermined value, the comparator 100 sends a charge instruction signal to the switching control circuit 43 which is driven to open the neutral point of the primary winding, through the switching circuit 42. As a result, the charging operation of the capacitors 16 and 18 ceases. Following this, the output voltage across the series-connected capacitors 16 and 18 is applied to an X-ray tube (not shown) through an X-ray switch (not shown). The capacitors discharge till the X-ray switch is opened.

At the termination of the discharge, i.e. the termination of X-ray radiation, the switching control circuit 43 coloses again the switching circuit 42 to start the charge of the capacitors 16 and 18. Through repeat of the operation, the X-ray tube produces pulsate X-rays.

In the power source, the open operation of the switching circuit 42 is accompanied by a given delay. The charging voltage varies due to the ripple phase of the charging voltage (the output voltage of the rectifiers 12 and 14) at the opening of the switching circuit 42. Thus, the X-ray absorption data collected is poor in reliability.

More specifically, the charging voltage including ripple as shown in FIG. 2(A) is stored in the capacitors 16 and 18. An X-ray is radiated at the timing as shown in FIG. 2(B). In this case, the switching control circuit 43 supplies to the switching circuit 42 an enabling (turn-on) signal during the period $t_1$, i.e. from immediately after the termination of the X-ray radiation till the charging voltage reaches a predetermined value. As shown in FIG. 2(D), upon receipt of the disabling (turn-off) signal, the switching circuit 42 turns off after a period of time $t_2$ as shown in FIG. 2(D). The turn-on time of the switching circuit 42 corresponds to the sum of the pulse width $t_1$ and the delay time $t_2$, namely, $t_1+t_2$. The amount of charge of the high-tension capacitors 16 and 18, however, varies depending on the ripple phase, as shown in FIG. 2(E) as well as fluctuation of the voltage of the power source 4. For this reason, the dosage of X-ray radiated varies, leading to inacurate data.

Accordingly, an object of the invention is to provide a pulsate X-ray generating apparatus of the type in which charges stored in a high-tension capacitor are discharged through an X-ray tube and the high-tension capacitor is recharged, the improvement of which is to keep the dosage of X-ray constant even if a DC high voltage for charging the capacitor includes ripple and the fluctuation, in a manner that the capacitor is always charged with a fixed amount of charges.

According to the invention, there is provided a pulsate X-ray generating apparatus comprising: a high-tension transformer; a rectifier for rectifying an AC voltage boosted from the transformer; at least one high-tension capacitor which is charged by a DC high voltage including a ripple component applied from the rectifier; an X-ray tube connected at the anode and cathode to both ends of the high-tension capacitor through an X-ray switch; a comparator for producing a coincidence signal when a charge voltage across the high-tension capacitor reaches a reference voltage; means for forming a charging instruction signal on the basis of an output signal from the comparator; a switching circuit connected between the high-tension transformer and an AC power source; a phase detection circuit for forming a pulse signal in synchronism with a given phase of the ripple component; and a switching control circuit which produces and supplies to the switching circuit an enable signal of said switching circuit when the pulse signal and the charging instruction signal are logically multiplied and a disable signal of said switching circuit when the comparator produces the coincident signal.

Other objects and features of the invention will be apparent from the following description taken in connection with the accompanying drawings, in which:

Referring now to FIG. 3, there is shown an embodiment of a pulsate X-ray generating apparatus according to the invention. In the figure, like reference numerals are used to designate substantially the same portions in FIG. 1, and the explanation of these portions will be omitted.

Figure 1:
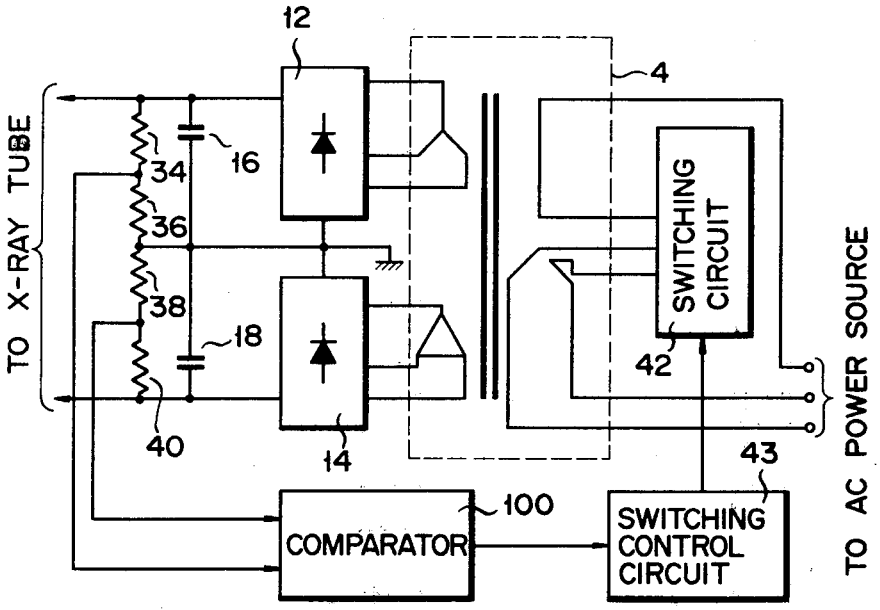
FIG. 1 PRIOR ART
FIG. 1 shows a circuit diagram of a conventional X-ray generating apparatus for producing pulsate X-rays.
Figure 2:
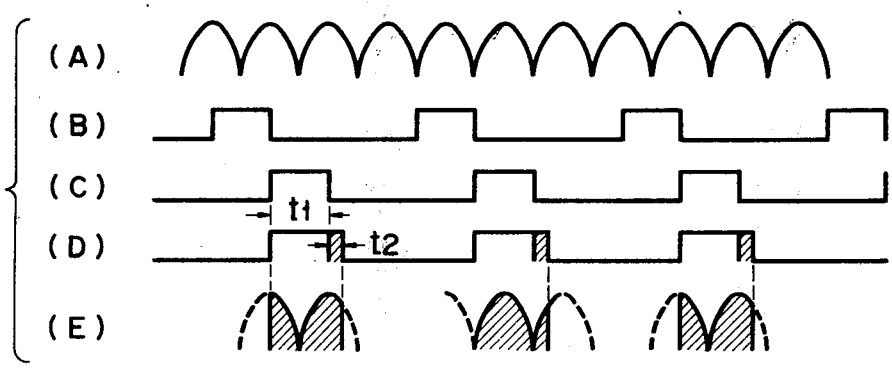
FIG. 2 PRIOR ART
FIG. 2 shows a set of signal waveforms for illustrating the operation of the circuit in FIG. 1.
Figure 3:
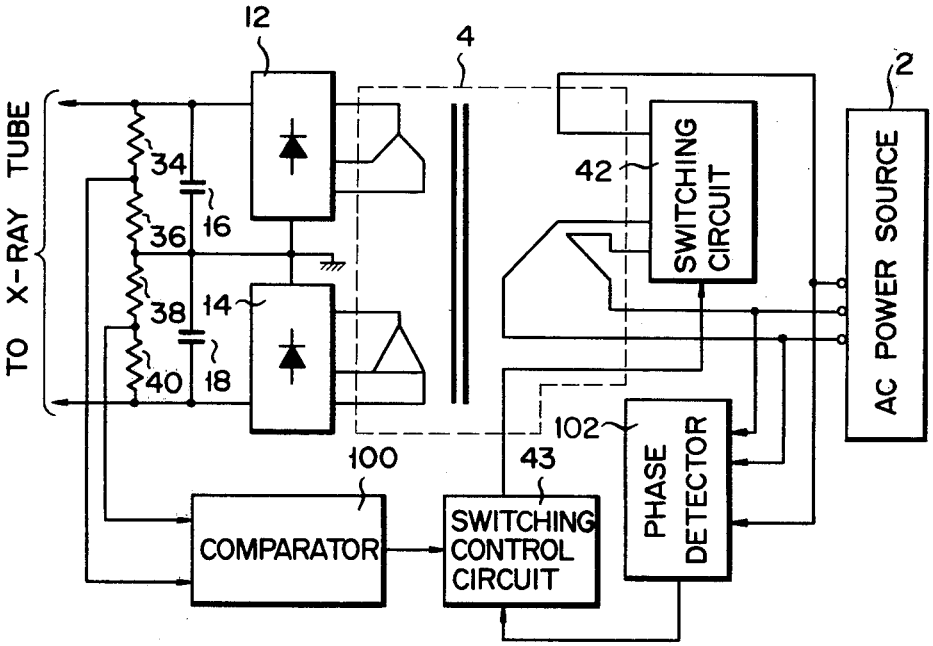
FIG. 3 shows a circuit diagram of an X-ray generating apparatus for producing pulsate X-rays, which is an embodiment of the invention.

In FIG. 3, a phase detector 102 receives a three-phase AC voltage to produce a pulse signal in synchronism with a given phase (for example, the bottom or peak phase) of ripple components included in the charging voltage wave. More particularly, a power from the three-phase AC power source 2 is supplied to a high-tension transformer 4 producing different six-phase AC. The output voltage from the transformer 4 is rectified by full-wave rectifier circuits 12 and 14. A DC voltage with ripple components is thus formed. A phase detector 45 produces pulses in synchronism with a given phase (for example, the bottom phase) of the ripple components including voltage from the full-wave rectifiers 12, 14 in a known manner. A switching circuit may be a well-known circuit including, for example, silicon controlled rectifiers. The switching control circuit 43 produces an enabling (turn-on) signal toward the switching circuit 42 when the pulse signal from a phase detector 45 and an X-ray exposure instruction signal from an X-ray radiation control circuit (not shown) are logically processed (multiplied). The switching control circuit 43 produces a (disabling) turn-off signal toward the switching circuit 42 when a comparator 100 to be described later produces a coincident signal. (When the silicon controlled rectifier elements are used, a gate pulse generating circuit is included in the circuit.) The comparator 100 compares a signal from breeder resistors 34, 36, 38 and 40 for detecting the charge voltage across the high-tension capacitors 16 and 18 with a reference voltage. When the signal from the breeder resistors reaches the reference voltage, the comparator 100 produces a control signal.

The operation of the circuit mentioned above will be described with reference to FIG. 4.

Figure 4:
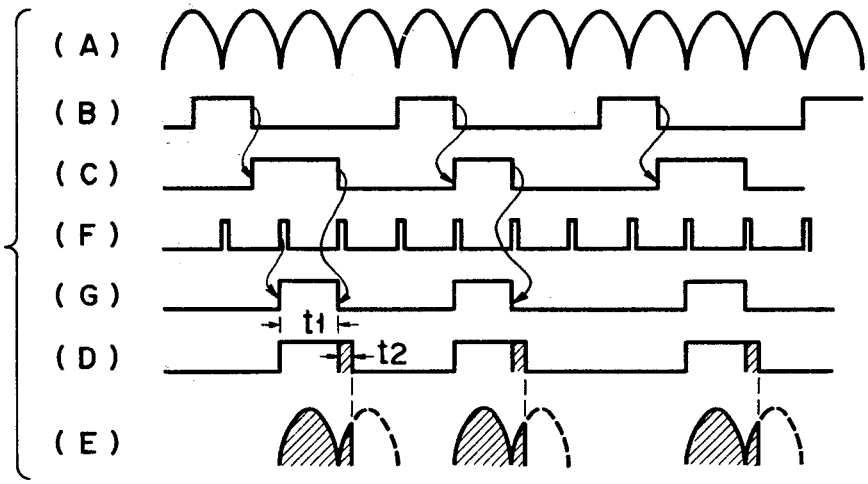
FIG. 4 shows a set of signal waveforms in order to explain the operation of the circuit shown in FIG. 3.

An AC power voltage from the three-phase AC power source 2 is boosted into a six-phase AC power by the high-tension transformer 4 and the boosted voltage is rectified by the high-tension rectifiers 12 and 14. The rectified voltage includes ripple components as shown in FIG. 4 (A). The capacitors 16 and 18 are charged by the rectified voltage. The charged capacitors 16 and 18 are discharged by an X-ray exposure instruction signal, as shown in FIG. 4 (B), which is derived from an X-ray radiation control circuit (not shown). The X-ray tube (not shown) radiates pulsate X-rays. In this case, charging the high (boosted) voltage into the high-tension capacitors 16, 18 is controlled in the following manner.

The comparator 100 generates a charging instruction signal as shown in FIG. 4(C) rising at the trailing edge of the X-ray exposure instruction signal for X-ray radiation and terminating at the time when the voltage charged in capacitors 16 and 18 reach the predetermined (reference voltage) value. Phase detector 102 provides switching control circuit 43 with pulse signals as shown in FIG. 4 (F) in synchronism with the ripple wave. The switching control circuit 43 produces an enabling (turn-on) signal rising at the time that the charging instruction signal and the phase detecting signal are received, as shown in FIG. 4 (G). The disable (turn-off) signal closes the switching circuit 42. As a result, the neutral point of the star-connected primary winding of the high-tension transformer 4 is closed so that the voltage from the three-phase power source is boosted by the high-tension transformer 4 and then is full-wave rectified by the rectifiers 12 and 14. The rectified voltage including the ripple components as shown in FIG. 4 (A) is used to charge the high-tension capacitors 16 and 18. At this time, the charging surely initiates at the vicinity of the null point of the ripple wave because it is synchronized with the phase detection signal. As the charging continues, the charge voltage across the capacitors 16 and 18 increase, and therefore, the voltage applied from the breeder resistors 34, 36, 38 and 40 to the comparator 100 also increases. When the voltage increases to reach the reference voltage, the comparator 100 sends signals for terminating the charge instruction signal to the switching control circuit 43. Upon termination of the charge instruction signal, the switching control circuit 43 produces a disable (turn-off) signal to the switching circuit 42 to open the neutral point of the primary of the high tension transformer 4. In fact, however, because of existence of the delay time (fixed) $t_2$ in the turn-off operation of the switching circuit 42, the period of the turn-on time is $(t_1+t_2)$, as shown in FIG. 4 (D). As a result, a voltage including ripple components as shown in FIG. 4 (E) charges the high-tension capacitors 16 and 18.

With this circuit construction, the charge of the high-tension capacitors 16 and 18 initiates at a given phase, i.e., the null point of the ripple wave and the charging curves are fixed if the voltage is invariable. Further, the delay time $t_2$ is constant and relatively short compared with the time $t_1$. Therefore, the voltage for charging capacitors 16 and 18 is fixed and stable.

As described above, in the invention relative to the X-ray generating apparatus in which a high-tension pulse voltage obtained by charging and discharging the high-tension capacitors at the secondary of a high-tension transformer, is applied to the X-ray tube to generate pulsate X-rays, the charging of the high-tension capacitors initiates at a given phase of the ripple wave included in the charge voltage. Therefore, the invention prevents variation of the charge voltage due to the timing of the operation in the switching circuit for charge control and even the fluctuation of the voltage of the power source. Accordingly, the invention improves the validbility of the X-ray adsorption data in the CT.

Figure 5:
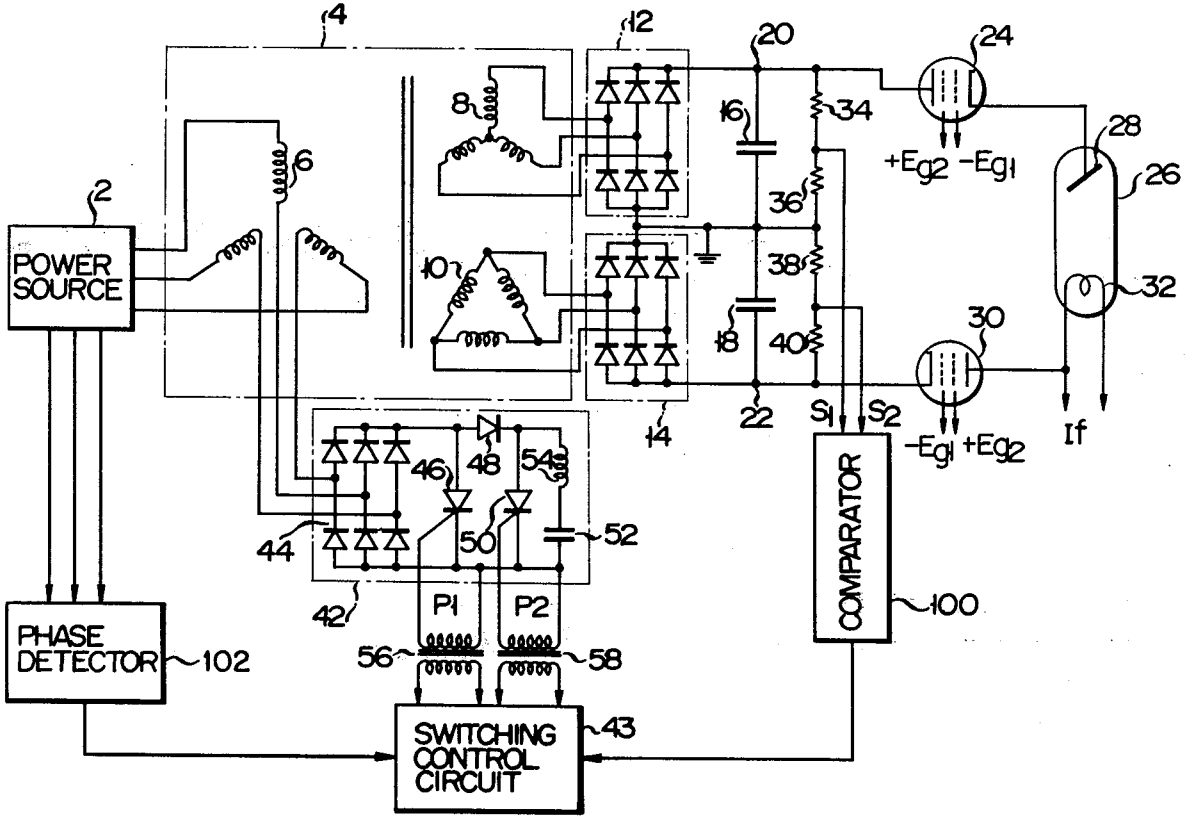
FIG. 5 shows circuit diagram of another embodiment of the X-ray generating apparatus according to the invention.
Figure 7:
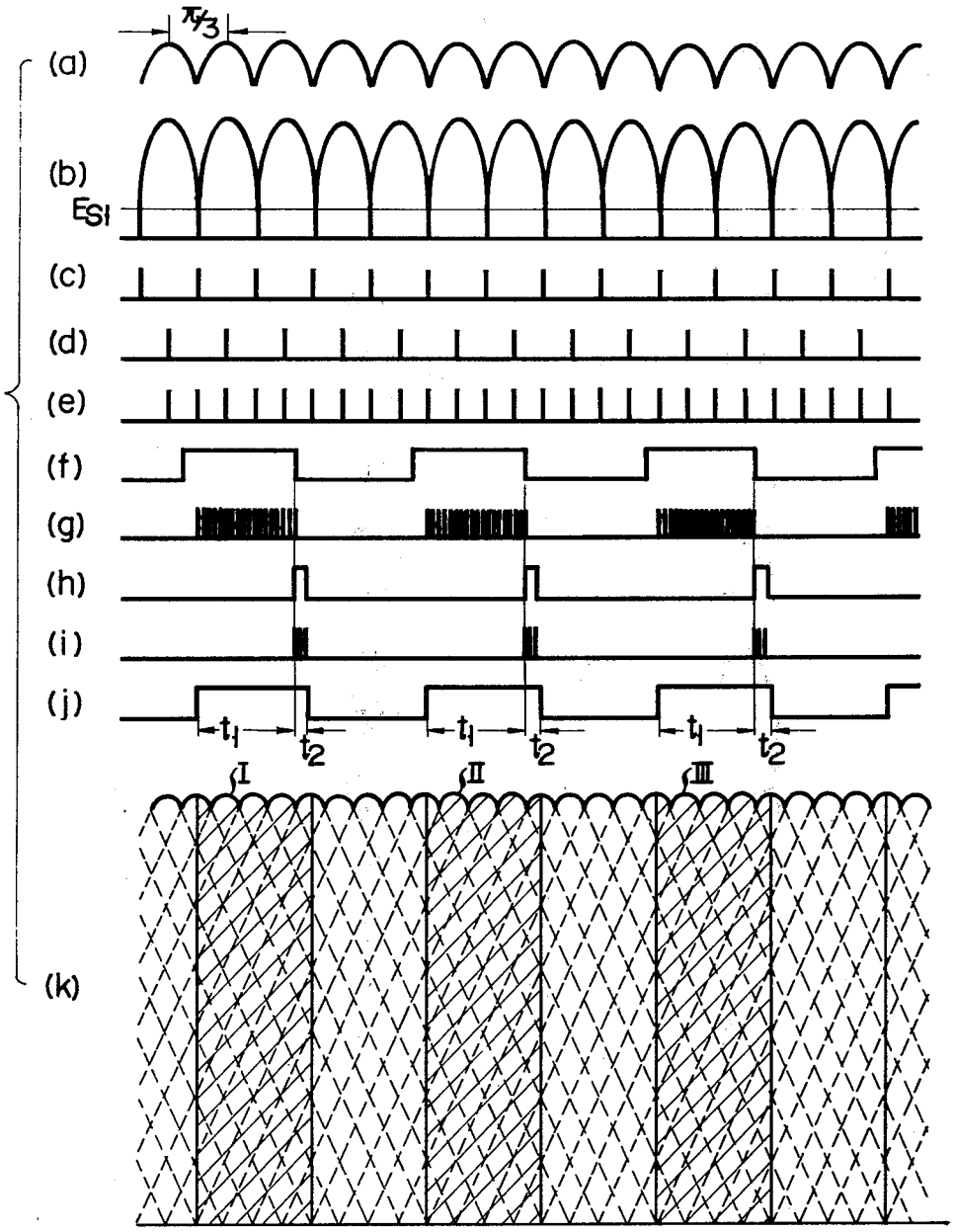
FIG. 7 shows a set of signal waveforms for illustrating the operation of the circuits in FIGS. 5 and 6.

Turning now to FIG. 5, a three-phase AC power source 2 is connected to a star-connected primary 6 of a high tension transformer 4. A high voltage, e.g. 150 kV at peak-to-peak, appears at the output terminals of the star-connected secondary winding 8 and a delta-connected secondary winding 10. The output terminal of the secondary winding 8 is connected to the input terminal of a three-phase full-wave rectifier 12 including six diodes. The secondary winding 10 is similarly connected to the input terminal of a three-phase full-wave rectifier 14 including six diodes. The DC output terminals of the rectifiers 12 and 14 are connected in series. The series circuit is further connected in parallel with two high-tension capacitors 16 and 18 being connected in series. The connection points between the rectifiers 12 and 14 and between the higher-tension capacitors 16 and 18 are grounded, so that the capacitor 16 is charged with +75 kV and the capacitor 18 with −75 kV. The output voltage of each rectifier 12 and 14 includes six ripples for one cycle of the three-phase AC. The ripples have a peak every $\pi/3$ phase. The ripple components of the output voltages of the rectifier 12 and 14 are phase-shifted by $\pi/6$. Therefore, the voltage wave appearing between the positive terminal 20 of the capacitor 16 and the negative terminal 22 of the capacitor 18, includes twelve ripple components for one cycle of the three-phase AC. The ripple wave of the output voltage of the rectifier 12 is as shown in FIG. 7 (a).

The positive terminal 20 of the capacitor 16 is connected to the anode of a tetrode tube 24 for high-voltage switching. A proper cut-off negative voltage $-E_{g1}$ is applied to the first grid of the tetrode tube 24. A proper positive voltage $+E_{g2}$ is also applied to the second grid. The cathode of the tetrode tube 24 is connected to the anode 28 of an X-ray tube 26. A tetrode tube 30 is connected at the cathode to the negative terminal 22 of the capacitor 18 and at the anode to the filament 32 of the X-ray tube 26. A proper cut-off negative voltage $-E_{g1}$ is applied to the first grid of the tube 30. A proper positive voltage $+E_{g2}$ is also applied to the second grid. An X-ray radiation control circuit (not shown) supplies an X-ray exposure instruction signal to the first grid of the tube 24 and 30. The X-ray exposure instruction signal makes the tetrode tubes 24 and 30 conductive. The resultant voltages across the capacitors 16 and 18 are applied between the anode 28 and cathode 32 of the X-ray tube 26, so that discharge takes place therebetween, resulting in X-ray radiation from the anode toward a patient (not shown). Incidentally, a filament heating control circuit (not shown) supplies a filament heating current $I_f$ to the filament 32 of the X-ray tube 26.

Series-connected resistors 34 and 36 are connected across the high-tension capacitor 16 and series-connected resistors 38 and 40 are connected across the capacitor 18. These series-connected resistor circuits are used to detect charge voltage of the capacitors 16 and 18. The charge voltage $S_1$ and $S_2$ are derived from the connection points between resistors 34 and 36 and between resistors 38 and 40, and are supplied to a comparator 100 to be described later. The neutral point of the star-connected primary 6 of the high tension transformer 4 is separated and connected to three AC input terminals of the three-phase full-wave rectifier circuit 44 provided in the switching circuit 42. The positive terminal of the DC output terminals of the rectifier circuit 44 is connected to the anodes of a thyristor 46 and a diode 48 in the switching circuit 42. The negative output terminal of the DC output terminals is connected to the cathodes of thyristors 46 and 50 and one of the terminals of a capacitor 52. The cathode of the thyristor 50 is connected to one terminal of a capacitor 52 and the anode thereof to one of the ends of an inductor 54. The other end of the inductor 54 is connected to the other terminal of the capacitor 52. The control gate terminals of the thyristors 46 and 50 each is connected to one of the terminals of the secondary of each pulse transformer 56 and 58, correspondingly. The other terminals of the secondaries are commonly connected to the DC negative output terminal of the rectifier circuit 44. Switching control signals $P_1$ and $P_2$ are fed from the secondaries of the pulse transformers 56 and 58 to which a switching control circuit 43 is connected.

Figure 6:
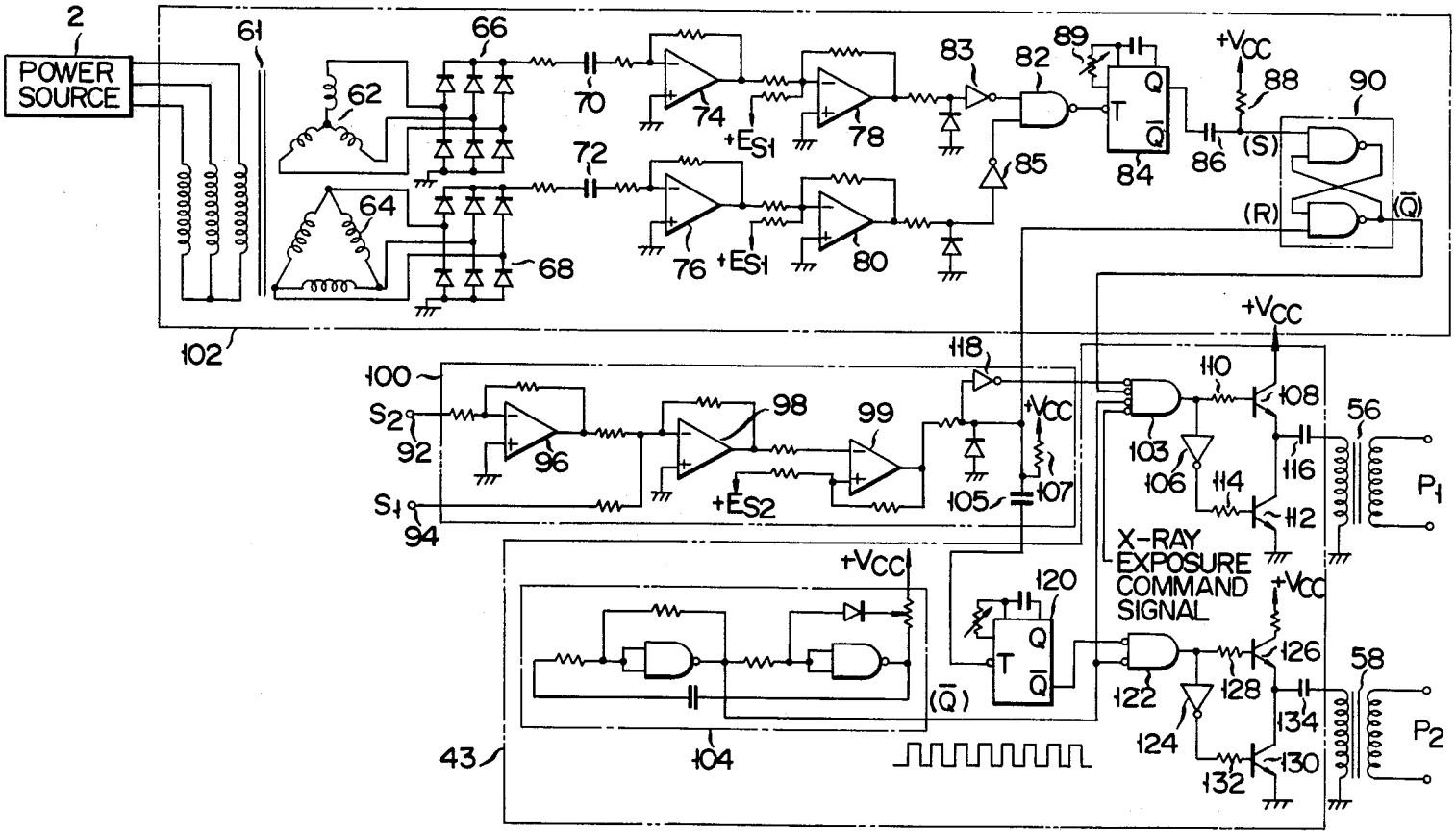
FIG. 6 shows a circuit diagram including a phase detector, a comparator and a switching control circuit which are connected to the FIG. 5 circuit.

The following explanation is the operation and construction of a circuit diagram including the phase detector 102, the comparator 100, and the switching control circuit 43. Reference is made to FIG. 6, wherein, the star-connected primary 61 of the voltage-reduction transformer 60 is connected to the three-phase power source 2. The AC voltage is properly voltage-reduced by the transformer 60 and is derived from the secondary windings 62 and 64 which are star-connected and delta-connected. The secondary windings 62, 64 are coupled with the AC input terminals of three-phase full-wave rectifiers 66 and 68. Therefore, the DC output voltages obtained from the DC positive output terminals of the rectifiers 66 and 68 include ripple components with the similar wave shape and period as those of the DC output voltage of the rectifiers 12 and 14 in FIG. 5. The positive output voltages of the rectifier circuits 66 and 68 are applied to capacitors 70 and 72 where the DC component is blocked. Only the ripple components are respectively applied to inversion input terminals of operational amplifiers 74 and 76 of which the non-inversion input terminals are grounded. The ripple signal passed through the capacitor 70 is shown in FIG. 7 (a), and the phase thereof is the same as that of the ripple components contained in the output DC voltage of the rectifier 12. The ripple component obtained from the capacitor 70 is amplified by an amplifier 74 and is converted into a signal with the wave form as shown in FIG. 7 (b). The wave form of the ripple component from the capacitor 72 is phase-shifted by $\pi/6$ from that of the capacitor 70, although not shown in FIG. 7. The outputs of the operational amplifiers 74 and 76 are respectively supplied to inversion input terminals of comparing operational amplifiers 78 and 80 of which the non-inversion input terminals are grounded. The reference voltage $+E_{S1}$ shown in FIG. 7 (b) is also applied to the inversion input terminals of the amplifiers 78, 80. Only when the output voltage of the operational amplifier 74 is lower than the reference voltage $+E_{S1}$, the polarity of the output voltage of the amplifier 78 is inverted from positive to negative. This operation is correspondingly applied to that of the other amplifer 80. The polarity-inverting period is extremely short, as shown in FIG. 7 (b), so that the output signal of the amplifier 78 has the wave form of narrow pulses as shown in FIG. 7 (c). The output waveform of the amplifier 80 is phase-shifted by $\pi/6$ from that of the amplifier 78, as shown in FIG. 7 (d). The output pulse from the amplifiers 78 and 80 are inverted at inverters 83, 85 and the inverted pulses are logically processed in an NAND gate 82 to be converted into pulses with intervals $\pi/6$ as shown in FIG. 7 (e). The output pulses of the NAND gate 82 are directed to a T-terminal of a monomultivibrator 84. The monomultivibrator 84 has a variable resistor 89 to shift the oscillating phase thereof. Whenever receiving at the T-terminal an input signal, the multivibrator 84 produces an output signal with a predetermined pulse width to be directed to a differential circuit including a capacitor 86 and a resistor 88 so that a phase-shifted (delayed) pulse may be obtained. Passed through the differential circuit, the output signal goes to a set terminal of an R-S type flip-flop 90. The flip-flop 90 is set by the differential pulse at the trailing edge of the output pulse of the multivibrator 84.

The charge voltage detection signals $S_1$ and $S_2$ (FIG. 5) are applied to input terminals 92 and 94 of the comparator 100, respectively. The signal $S_2$ passes through the input terminal 92 to reach the inversion input terminal of an operational amplifier 96 of which the non-inversion input terminal is grounded. The signal $S_2$ is inverted by the operational amplifier 96. The inverted signal $\overline{S_2}$ and signal $\overline{S_1}$ are commonly applied to an inversion input terminal of an operational amplifier 98 of which the non-inversion input terminal is grounded, and are summed by the operational amplifier 98. The summed voltage corresponds to the resultant charging voltages across the capacitors 16 and 18 in FIG. 5, i.e. the value of the voltage to be applied to the X-ray tube 26. The summed output signal of the addition amplifier 98 is compared with the reference voltage $+E_{S2}$ in an operational amplifier 99. When the output voltage of the amplifier 98 falls below the reference voltage $+E_{S2}$, the output of the amplifier 99 becomes negative and the negative output resets the R-S flip-flop 90. At the same time, the negative output is supplied through an inverter 118 to the first gate of an AND gate 103 to enable it. The flip-flop 90 is set by the differential pulse at the trailing edge of the pulse coming in later as shown in FIG. 7 (e). The output Q is supplied to the second gate of the AND gate 103 to enable it. The exposure instruction signal is also supplied to the fourth gate of the AND gate 103. Therefore, during the period of non-exposure time an output pulse of 20 kHz, for example, is supplied from a pulse generator 104 of an astable-multivibrator to the third gate of the AND gate 103. The 20 kHz pulse passes through the AND gate 103 to reach the inverter 106 and through a resistor 110 to the base of a transistor 108. The output pulse supplied to the inverter 106 is inverted thereby and applied to the base of a transistor 112 through a base resistor 114. Therefore, the transistors 108 and 112 are alternately conductive one time for each period of the 20 kHz pulse. Upon conduction of the transistor 108, the 20 kHz pulse flows through the collector-emitter circuit of the transistor 108, a capacitor 116, and the primary winding of the pulse transformer 56 to the ground. As a result, the 20 kHz pulse as a switching control signal $P_1$ is induced in the secondary winding of the pulse transformer 56 in FIG. 5. When the transistor 112 is conductive, an inverse directional current flows from the capacitor 116 through the transistor 112 and the primary winding of the pulse transformer 56 so that the opposite polarity voltage is induced in the secondary winding of the pulse transformer 56. The reason why the phase-inverted pulses are alternately applied to the primary winding of the pulse transformer 56 is to prevent the core of the transformer 56 from being magnetized deviatedly or non-uniformly. Thus formed pulse is applied to the control gate and the cathode of the thyristor 46 in the switching circuit 42 shown in FIG. 5, from the secondary winding of the transformer 56. The positive pulse applied renders the thyristor 46 conductive. When the thyristor 46 is conductive, the neutral point of the primary winding 6 of the high-tension transformer 4 is connected one another through the rectifier circuit 44 and the thyristor 46, with the result that three-phase AC current flows into the primary winding 6, and thus charging into the high-tension capacitors 16 and 18 initiates.

Following the initiation of the charging, the voltage levels at the connection points between resistors 34 and 36 and resistors 38 and 40, gradually increase. When the output voltages representing the charging voltage levels in the capacitors 16 and 18 reach the reference voltage $+E_{S2}$, the output voltage of the comparing operational amplifier 99 is inverted from negative to positive. Because of the positive output signal from the amplifier 99, the first gate of the AND gate 103 is simultaneously disabled so that the pusle supply to the bases of the transistors 108 and 112 ceases. FIG. 7 (f) shows an output signal of the amplifier 99 and FIG. 7 (g) an output signal wave form of the AND gate 103. Here, illustrated is that, when the output signal from the amplifier 99 is negative, the AND gate 103 produces an output pulse from the pulse generator 104.

Simultaneously, the positive output of the amplifier 99 is supplied to the T-terminal of the monostable multivibrator 120 through a differential circuit of resistor 107 and capacitor 105. Upon receipt of the positive pulse, the multivibrator 120 is triggered to produce a narrow width output pulse shown in FIG. 7 (h). The output pulse is supplied to the first gate of an AND gate 122 so that an output pulse of the pulse generator 104 goes to an inverter 124 through an AND gate 122 and to the base of the transistor 126 through a base resistor 128, during the period corresponding to the output signal. The output signal waveform of the AND gate 122 is as shown in FIG. 7 (i). The pulse inverted by the inverter 124 is applied through the base resistor 132 to the base of the transistor 130. When the pulse shown in FIG. 7 (i) is applied through the base resistor 128 to the base of the transistor 126, the transistor 126 is conductive so that pulse current flows through a route consisting of the transistor 126, the capacitor 134, the primary winding of the pulse transformer 58 and ground. The output pulse $P_2$ is derived from the secondary winding. The output pulse $P_2$ is applied to the control gate of the thyristor 50. As a result, charges stored in the capacitor 52 discharge through the thyristor 50 and the inductor 54 so that an inverse bias voltage is simultaneously applied to the thyristors 46 and 50, turning off the thyristors. Upon turning off the thyristor the neutral point of the primary winding 6 of the high-tension transformer 4 is open, thereby to cease the charging into the capacitors 16 and 18. The period of charging times of the capacitors 16 and 18 are longer by the "$t_2$" than the charging instruction output period "$t_1$" of the AND gate 103, shown in FIG. 7 (j). In this embodiment, the charging initiation is always fixed at the predetermined level position of the ripple component shown in FIG. 7 (a). Therefore, the delay time "$t_2$" necessarily affects the specified phase of the ripple wave, as shown in FIG. 7 (k). Accordingly, slanted areas I, II and III shown in FIG. 7 (k) are all the same, so that the charge voltages for the capacitors 16 and 18 are always constant. This eliminates variation of the X-ray dosage generated from the X-ray tube 26. The charging initiation may be set at the other suitable level, e.g. the peak level of the ripple component, in addition to the minimum level as mentioned above.

What we claim is:

1. A pulsate X-ray generating apparatus comprising:

a switching circuit for coupling to and from a power source;

a high-tension transformer having primary and secondary windings, said primary winding being coupled to said switching circuit, said transformer producing a boosted AC voltage;

a rectifier coupled to said secondary winding for rectifying said boosted AC voltage producing a DC voltage having a ripple component;

at least one high-tension capacitor coupled to said DC voltage from said rectifier;

an X-ray switch coupled to said capacitor;

an X-ray tube coupled to said X-ray switch;

a comparator coupled to said capacitor for producing a charge instruction signal as long as the detected charge voltage of said high-tension capacitor is below a predetermined threshold level;

a phase detector for generating a pulse signal in synchronism with a given phase of said ripple component of said DC voltage; and a switching control circuit coupled to said comparator and to said phase detector and receiving signals therefrom for producing a control signal for controlling said switching circuit, said control signal enabling said switching circuit only when both a charge instruction signal from said comparator and a pulse from said phase detector are present and maintaining the enabled condition as long as said charge instruction signal remains present.

2. A pulsate X-ray generating apparatus according to claim 1, wherein said comparator includes an operational amplifier having a non-inverting input terminal to which a reference voltage is applied and an inverting input terminal to which the charged voltage across said high-tension capacitor is applied.

3. A pulsate X-ray generating apparatus according to claim 2, in wherein said comparator includes means for producing an output signal from said operational amplifier whenever the charge voltage of said high-tension capacitor is lower than said reference voltage, said output signal being said charge instruction signal coupled to said switching circuit.

4. A pulsate X-ray generating apparatus according to claim 1, wherein said high-tension transformer has a star-connected primary winding having a separated neutral point, and wherein said switching circuit includes a three-phase full-wave rectifier coupled to said separated neutral point, a first thyristor having a control gate and forwardly coupled between the DC output terminals of said three phase full wave rectifier, a second thyristor coupled across said first thyristor and having a control gate, a thyristor commutation circuit, means for applying said enabling signal from said switching control circuit to said control gate of said first thyristor to render said first thyristor conductive, and means for applying said disabling signal to said control gate of said second thyristor to render said second thyristor conductive and for commutating said first and second thyristors by action of said commutation circuit.

5. A pulsate X-ray generating apparatus according to claim 1, wherein said phase detector comprises a first operational amplifier for amplifying ripple components of said power source in synchronism with said ripple components of said DC rectified high voltage from said rectifier, a second operational amplifier for comparing the output signal from said first operational amplifier and the reference voltage and for producing an output signal when the former is lower than the latter, a monostable multivibrator which is triggered by the output signal from said second operational amplifier, a differential circuit for differentiating the output signal from said monostable multivibrator, an R-S flip-flop which is set by the output signal from said differential amplifier, and means for providing a reset output from said R-s flip-flop as a pulse signal from said phase detector toward said switching control circuit.

6. A pulsate X-ray generating apparatus according to claim 1, wherein said switching control circuit comprises:

a pulse generating circuit;

a first AND gate which is enabled by the pulse signal from said phase detector and the charge instruction signal from said comparator for gating the output pulse from said pulse generating circuit to pass therethrough;

a first transistor which is coupled to and controlled by the output pulse from said first AND gate;

a first inverter for inverting the output pulse of said first AND gate;

a second transistor which is coupled to and controlled by the output signal from said first inverter said second transistor being coupled in series with said first transistor;

a first capacitor which is charged when said first transistor is conductive;

a first pulse transformer having a primary winding to which charge pulse current for said first capacitor flows;

a monostable multivibrator which is triggered by said comparator output signal;

a second AND gate which is enabled by the output from said monostable multivibrator to permit the output pulse from said pulse generating circuit to pass therethrough;

a third transistor which is controlled by the output pulse from said second AND gate;

a second inverter for inverting the output pulse from said second AND gate;

a fourth transistor which is controlled by the output signal from said second inverter and coupled in series with said third transistor;

a second capacitor which is charged when said third transistor is conductive;

a second pulse transformer with the secondary winding through which the charge pulse for said second capacitor flows; and means for producing the output signal from said first pulse transformer as a turned-on signal and the output signal from said second pulse transformer as a turned-off signal.

* * * * *

UNITED STATES PATENT AND TRADEMARK OFFICE

CERTIFICATE OF CORRECTION

PATENT NO. : 4,200,795

DATED : April 29, 1980

INVENTOR(S) : Kawamura et al

It is certified that error appears in the above—identified patent and that said Letters Patent is hereby corrected as shown below:

IN THE SPECIFICATION:

Column 6, line 51, change "monomultivibrator" to --monostable multivibrator--;

line 52, change "monomultivibrator" to --monostable multivibrator--;

line 65, change "$S_2$" to --$S_1$--;

line 68, change "$S_2$" to --$S_1$--;

Column 7, line 2, change "$\overline{S}_2$" to --$\overline{S}_1$--;

line 2, change "$\overline{S}_1$" to --$S_2$--;

line 13, change "negative and the negative" to --positive--;

line 14, delete "output resets the R-S flip-flop 90";

line 15, change "negative" to --positive--;

line 16, change "an AND" to --a--;

UNITED STATES PATENT AND TRADEMARK OFFICE

CERTIFICATE OF CORRECTION

PATENT NO. : 4,200,795

DATED : April 29, 1980

INVENTOR(S) : Kawamura et al

It is certified that error appears in the above—identified patent and that said Letters Patent is hereby corrected as shown below:

Column 7, line 16, delete "AND";

line 20, delete "AND";

line 22, delete "AND";

line 66, change "negative" to --positive--;

line 66, change "positive" to --negative--;

line 67, change "positive" to --negative--;

line 68, delete "AND";

Column 8, line 1, change "pusle" to --pulse--;

line 4, delete "AND";

line 6, change "negative" to --positive--;

line 6, delete "AND";

line 8, change "positive" to --negative--;

line 11, delete "positive";

line 14, after "pulse", insert

--of terminal $\overline{Q}$ of the multivibrator 120--;

UNITED STATES PATENT AND TRADEMARK OFFICE

CERTIFICATE OF CORRECTION

PATENT NO. : 4,200,795

DATED : April 29, 1980

INVENTOR(S) : Kawamura et al

It is certified that error appears in the above—identified patent and that said Letters Patent is hereby corrected as shown below:

Column 8, line 14, change "an AND" to --a--;

line 16, change "an AND" to --the--;

line 19, delete "AND";

line 39, delete "AND".

IN THE DRAWINGS:

Please change the reference numerals of the terminals 92 and 94 of FIGURE 6 to $S_1$ and $S_2$, respectively.

Signed and Sealed this

*Fourth* Day of *August 1981*

[SEAL]

*Attest:*

GERALD J. MOSSINGHOFF

*Attesting Officer*

*Commissioner of Patents and Trademarks*